US006273019B1

(12) United States Patent
Ciamillo, II

(10) Patent No.: US 6,273,019 B1
(45) Date of Patent: Aug. 14, 2001

(54) REGULATED PRESSURIZED SYSTEM AND PRESSURE REGULATOR FOR USE IN AN AMBIENT FLUID ENVIRONMENT, AND METHOD OF PRESSURE REGULATION

(75) Inventor: Theodore Joseph Ciamillo, II, Lawrenceville, GA (US)

(73) Assignee: Eli Shmid, Modiin (IL)

( * ) Notice: Subject to any disclaimer, the term of this patent is extended or adjusted under 35 U.S.C. 154(b) by 0 days.

(21) Appl. No.: 09/301,215

(22) Filed: Apr. 28, 1999

(51) Int. Cl.[7] ..... B63G 8/00
(52) U.S. Cl. ..... 114/312; 137/81.2; 128/204.18
(58) Field of Search ..... 114/312; 137/81.2; 128/204.18

(56) References Cited

U.S. PATENT DOCUMENTS 3,387,580 * 6/1968 Walker ..... 114/312
4,903,628 * 2/1990 Lansford ..... 114/312
5,368,022 * 11/1994 Wagner ..... 128/205.24

OTHER PUBLICATIONS

"Underwater Flying Machines, A Buyer's Guide to Scooters and DPV's," by Daryl Carson, *Scuba Times*, Feb., 1998, pp. 10–14.

* cited by examiner

*Primary Examiner*—Ed Swinehart
(74) *Attorney, Agent, or Firm*—Bernstein & Assoc., P.C.; Jason A. Bernstein

(57) ABSTRACT

A regulated pressurized system for use in an ambient fluid environment such as water and for mounting to an underwater vehicle, having at least one compressed fluid supply such as air in a tank. A pressure regulator is connected by tubing to the air tank, the regulator capable of regulating an outlet air pressure relative to an ambient pressure of the water. At least one main housing has at least one pressure relief valve connected by a tube to the pressure regulator. At least one electric control system is preferably provided contained within the main housing.

A plurality of first peripheral housings are provided, each first peripheral housing having a first tube coupled to the main housing with the tubes having electric wires routed therethrough and interconnecting at least one first peripheral electric device to the main electric control system. A plurality of second peripheral housings are provided, each second peripheral housing having a second tube coupled to a first housing with the second tubes having electric wires routed therethrough and interconnecting at least one second peripheral electric device to at least one first electric device.

Also, a method of regulating pressure in a system of housings in an ambient fluid environment such as water. The method provides for pressurizing submersible housings containing electric devices, and regulating the air pressure relative to a variable ambient pressure of the water.

27 Claims, 3 Drawing Sheets

REGULATED PRESSURIZED SYSTEM AND PRESSURE REGULATOR FOR USE IN AN AMBIENT FLUID ENVIRONMENT, AND METHOD OF PRESSURE REGULATION

FIELD OF THE INVENTION

The present invention relates generally to regulated pressurized systems, and more particularly, to a regulated pressurized system for achieving and maintaining a positive air pressure within submersible housings for electrical systems, underwater equipment, instrumentation and/or the like, and a pressure regulator for a regulated pressurized system.

BRIEF DESCRIPTION OF THE PRIOR ART

Underwater divers commonly use self-contained underwater breathing apparatus (commonly known by its acronym as SCUBA gear) providing a portable, regulated air supply. Many divers desire the capability to dive deeper, stay underwater longer, travel faster and over more area while underwater, to generally accomplish more while underwater than by leg-powered fins and SCUBA gear alone. In order to accomplish these objects, there have been developed a number of underwater propulsion apparatus for divers, such as underwater scooters and diver propulsion vehicles (DPVs).

There are several such known scooters, including those made by Toledo Company, by Dacor, and by Oceanic. These scooters generally comprise a handheld propulsion device that tows the diver behind the scooter as the diver grips the rear of the unit. As such, scooters are generally used by recreational divers in order to conserve energy by not having to swim or fight currents.

There are several known DPVs, including those made by American Underwater Lighting, by Farallon, by Aquazepp, and by Marine Gear Corporation. One such DPV by Marine Gear Corporation is disclosed by U.S. Pat. No. Des. 399,183 to Ciamillo II. Relative to scooters, DPVs generally comprise a longer body with an integral saddle or sling so that the diver rides on the vehicle, larger and/or additional motor and battery systems for increased speed, range, and underwater time, and more sophisticated and responsive controls for speed and maneuverability. As such, DPVs are most commonly used by commercial, military, technical, and serious recreational divers.

The underwater propulsion apparatus described hereinabove all have electrical systems generally comprising at least one battery, at least one motor, at least one propeller on a shaft connected to the motor, and at one control system for operating the motor. These components are typically provided in at least one sealed housing to keep out water when submersed. These housings are subjected to extreme pressures, especially for deep diving DPVs, because of the increased ambient pressure on the housing when descending underwater. For example, at a 250 foot depth of typical sea water, the ambient pressure on the housing is approximately 125 pounds per square inch (psi).

Housings for these electrical system components are therefore commonly designed to withstand extreme pressures. Known underwater propulsion apparatus typically provide housings having a wall thickness and made of a material selected for withstanding the extreme pressures. A significant disadvantage of these housings is that they are necessarily bulkier and heavier because of the increased wall thickness. Such housings may be provided with higher grade materials with greater strength properties, but such materials are generally significantly more costly.

Furthermore, DPVs typically have the motor or motors towards the rear of the vehicle for stability and visibility, and certain controls and/or instrumentation toward the front of the vehicle for access thereto, such that multiple housings are sometimes provided for the various electrical system components. The housings are provided with apertures for receiving electric power and/or control wires therethrough. While such apertures typically have a seal disposed about the wire and/or a seal disposed about a conduit containing the wire and received in the aperture, these seals present a weak spot for potential failure thereof and water intrusion into the housing. Where the wire is not contained in a conduit or is contained in a conduit not designed to withstand extreme pressure and which then leaks, the salt water may access and degrade the wire insulation over time with a resulting failure of the insulation, shorting of the electrical system, and failure of costly electrical components at very importune occasions and in very dangerous and inhospitable environments. Even where the wire is contained in a conduit designed to withstand extreme pressure, the pressure may eventually cause small undetectable leaks in the conduit with the same or a similar catastrophic result.

There are also known manned submersible vehicles having equipment and/or components arranged outside the hull of the vehicle in housings. Additionally, there are known unmanned underwater propulsion devices such as remote operated vehicles (ROVs) and autonomous underwater vehicles (AUVs) for housing and transporting underwater equipment such as audio and video equipment, ambient condition measurement devices, and other scientific instrumentation. None of these submersible vehicles are known to provide a solution to housing electrical and other submersible equipment other than providing housing walls with an increased thickness, of a higher strength material, and/or with a curved shape.

Accordingly, what is needed but not found in the prior art is a system of submersible housings interconnected by tubing for containing and protecting from water intrusion electrical systems, underwater equipment, instrumentation and/or the like where the housings and tubing are made of low weight materials with minimal wall thickness yet the housing and tubing also provide a superior protective seal against water leakage at moderate and extreme depths of water.

SUMMARY OF THE INVENTION

Generally described, the present invention provides a regulated pressurized system for use in an ambient fluid environment such as water. A preferred embodiment of the present invention provides at least one compressed fluid supply, preferably compressed air in a submersible tank. At least one pressure regulator is preferably provided having an air inlet connected by tubing to the compressed air supply and an air outlet, the regulator capable of regulating an outlet air pressure relative to an ambient pressure of the water. A three way joint is preferably provided with an inlet connected by tubing to the air supply, a first outlet, and a second outlet connected by tubing to the pressure regulator air inlet, wherein the first outlet is available for pressurizing an external device.

At least one main housing is preferably provided having at least one pressure relief valve and connected by a relief valve tube to the pressure regulator air outlet. At least one electric control system is preferably provided contained within the main housing.

A plurality of first peripheral housings is preferably provided, each first peripheral housing having a first tube coupled to the main housing in a parallel configuration. A plurality of first peripheral electric devices is preferably provided contained within the first peripheral housings, wherein the first peripheral electric devices comprise at least one pressure gauge, at least one power supply, at least one power supply meter, and at least one motor control system. A plurality of first peripheral electric wires are preferably provided interconnected between the electric control system and each of the first electric devices, the wires extending through the first tubing.

A plurality of second peripheral housings is preferably provided, each second peripheral housing having a second tube coupled to the motor control system peripheral housing in a parallel configuration. A plurality of second peripheral electric devices are preferably provided contained within the second peripheral housings, wherein the second peripheral electric devices comprise at least one motor switch and at least one motor and propeller. A plurality of second peripheral electric wires are preferably provided interconnected between the motor control system and each of the second peripheral electric devices, the second wires extending through the second tubing. The regulated pressurized system is preferably provided mounted to a submersible body, such as an underwater vehicle, a DPV, or the like.

In the preferred embodiment, the pressure regulator is provided with a casing having a first chamber and a second chamber with a first portion and a second portion defined in the second chamber. The casing has a fluid inlet member with a bore extending therethrough and a fluid outlet member with a bore extending therethrough, the inlet member having a tubing connector for coupling to a compressed fluid supply and the outlet member having a tubing connector for coupling to a pressurized system. At least one ambient access opening is preferably defined in the second chamber first portion.

A rod is preferably provided slidingly extending through a wall dividing the first and second chambers with the rod generally axially aligned with the inlet bore. The rod preferably has a first end with a cross-sectional area disposed within the first chamber, and a seat attached thereto that is capable of sealingly covering the inlet bore upon sliding of the rod, and having a second end disposed within the second chamber. The rod preferably has a portion with a bore defined axially therethrough and extending through the rod second end and an aperture defined in a sidewall thereof generally proximate the rod first end, the rod aperture in communication with the rod bore.

A piston head is preferably provided slidingly movable within the second chamber and having a bore coextensively defined therethrough. The head preferably has a first end attached to the rod second end wherein the head bore and the rod bore are generally axially aligned, with the first end having a surface area defined thereon. The head preferably has a second end with a surface area defined thereon. The second end surface area and the rod cross-sectional area preferably define a ratio that is about equal to a ratio defined by an inlet pressure in the first chamber and a generally constant positive pressure differential of a variable outlet pressure in the second chamber second portion to the variable ambient pressure. Preferably, the rod cross-sectional area, the head first end surface area, and the head second end surface area are defined such that the inlet pressure acting on the rod cross-sectional area plus the variable ambient pressure acting on the head first end surface area are about equal to or greater than the variable outlet pressure acting on the head second end surface area.

The present invention further provides a method of regulating pressure in a system of housings in an ambient fluid environment such as water. The preferred method comprises the steps of conveying a compressed fluid such as air in a submersible tank at an inlet pressure into a pressure regulator, decreasing the constant inlet pressure to a variable outlet pressure, regulating the variable outlet pressure at a positive pressure differential relative to the ambient water pressure wherein the variable outlet pressure is increased upon an increase of the ambient pressure such as when descending in water, conveying the air at the variable outlet pressure from the pressure regulator into at least one main housing such that the main housing is maintained at the positive pressure differential relative to the ambient pressure, conveying the air at the variable outlet pressure from the main housing through tubing into at least one peripheral housing such that the peripheral housing is maintained at the positive pressure differential relative to the ambient water pressure, storing an electric control system in the main housing and storing peripheral electric devices in the peripheral housings, routing electric wires through the tubing for connection between the electric control system and the peripheral electric devices, and releasing the variable outlet pressure from the main housing upon a decrease in the ambient water pressure such as when ascending in the water.

Accordingly, it is an object of the present invention to seal and protect electrical systems, underwater equipment, instrumentation and/or the like when diving, exploring, and ascending in moderate to extreme depths of an underwater environment, by providing a system of at least one and preferably a plurality of submersible housings capable of withstanding extreme and varying ambient pressures without leaking.

It is another object to provide the submersible housings with minimal structural requirements to permit compactness and low weight yet also with a superior protective seal against water leakage, by providing a compressed air supply, a pressure regulator connected to the housings by pneumatic tubing, and a relief valve on at least one housing so as to maintain a pressure within the housings at a nominal differential relative to the ambient pressure at a given depth of water.

It is yet another object to seal and protect any electrical system control and/or power wiring from access by the ambient water and from degradation and/or failure thereof, by sizing and arranging the pressurized pneumatic tubing interconnecting the housings so as to be capable of receiving the electrical wiring therethrough and by routing the electrical wiring through the tubing.

It is a further object to provide for a visual indication of a leak in any of the housings by achieving and maintaining a positive pressure within the housings and tubing so that air bubbles are released from any housing leak, the pressure preferably maintained at about 10 psi relative to the ambient pressure at any given depth under typical usage conditions, and even during a rapid ascent and/or descent to maintain the housing pressure in the range of about 0 to 50 psi relative to the varying ambient pressure, by providing a pressure regulator having a piston cylinder valve and three chambers to produce a pressure drop across the regulator relative to a variable reference pressure.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENT

Figures 1, 3, 4:
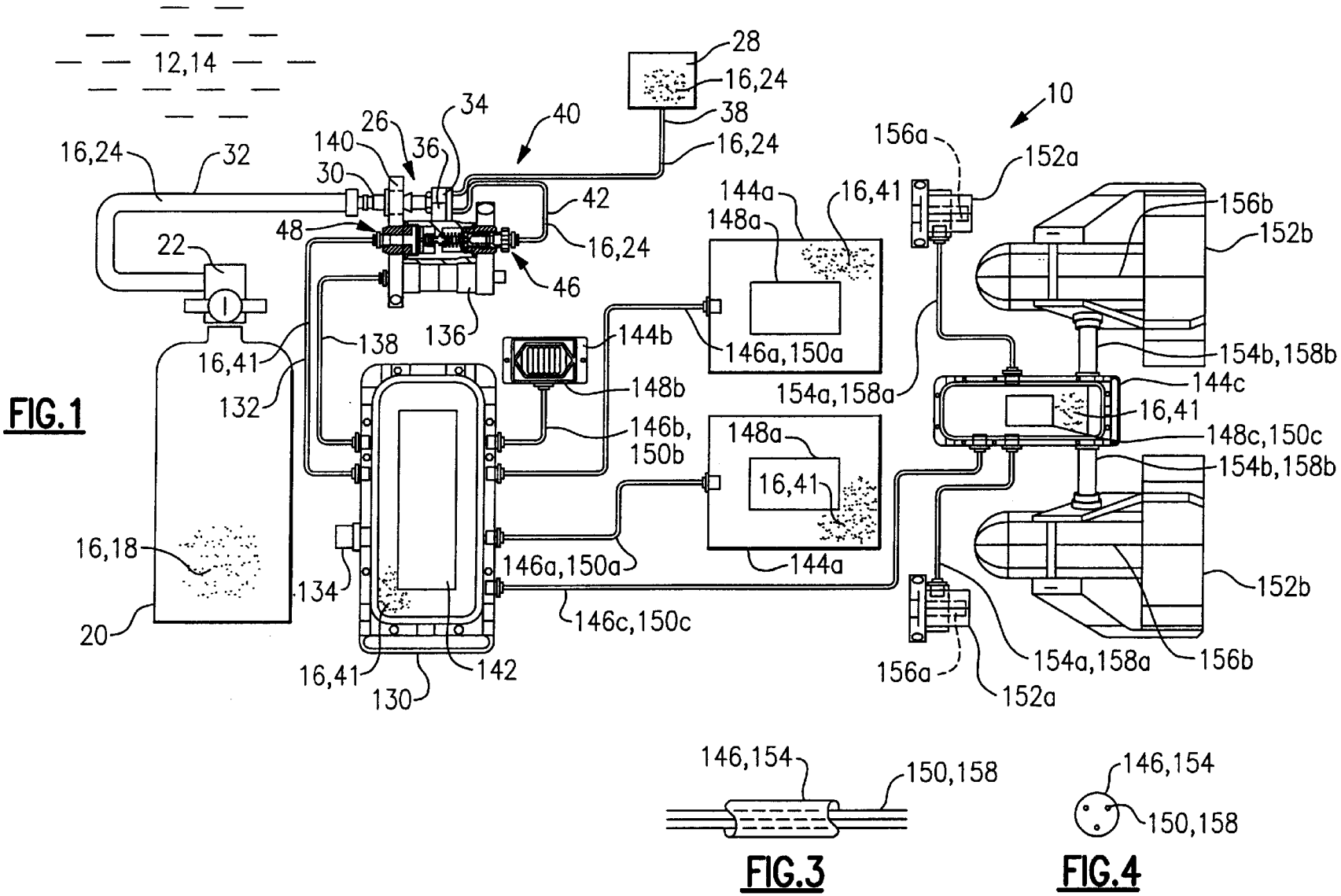
FIG. 1 is a schematic of a preferred embodiment of the regulated pressurized electrical system of the present invention.
FIG. 3 is a side detail view of wiring routed through tubing of the preferred embodiment.
FIG. 4 is a plan view of FIG. 3.

Referring now to FIG. 1, there is illustrated a preferred embodiment of the present invention, providing a regulated pressurized system 10 for use in an ambient fluid environment 12. The ambient fluid 12 may be sea water, fresh water, air, or a like fluid. The ambient fluid 12 has an ambient pressure 14 that varies in accordance with the altitude, for example, the ambient pressure 14 of sea water increases as the system 10 descends therein.

The system is used with a fluid 16 compressed to a pressure 18 and preferably provided in a rigid container 20. The compressed fluid and container 20 may be provided with the system 10 or provided separately. Preferably, the compressed fluid 16 is air and the container 20 is a conventional SCUBA tank. Such tanks are readily available, and are typically rated for air at a pressurize 18 up to about 3000 psi and provided with a pressure regulator 22 for reducing the fluid to an inlet pressure 24 of about 135 psi for distributing pressurized air to a buoyancy device (not shown) and a regulator (not shown) for further reducing the pressure 24 for human respiration. Optionally, other gaseous and/or liquid fluids may be suitably employed, such as oxygen, nitrogen, and mixtures of these and/or other gases, such fluids selected to be generally light relative to the ambient fluid 14 and capable of stable compression and use and other containers 18 may be suitably employed, such containers selected to withstand the desired pressure to be contained therein.

A three-way joint 26 is preferably provided to allow use of the compressed fluid 16 to pressurize the system 10 and to pressurize one or more external devices 28 such as a buoyancy device or other pressurized devices. The joint 26 is preferably made of a metal, a composite or a like material selected for high strength and low weight, and fabricated by techniques known to those skilled in the art.

The joint 26 preferably has a fluid inlet 30, a first outlet 34, and a second outlet 36. The fluid inlet 30 may be coupled to the fluid container 20 with a tubing 32 for receiving the fluid 16 therethrough. Preferably, tubing 32 is provided by conventional pneumatic tubing and selected for strength, pressure rating, and ease of manipulation, though alternative tubing types may be suitably employed in a given application.

The first outlet 34 may be coupled to the external device 28 with tubing 38 for receiving the fluid 16 therethrough. The second outlet 34 is coupled to a pressure regulator 40 with tubing 42 for receiving the fluid 16 therethrough. Preferably, tubing 38 and 40 is provided by conventional pneumatic tubing and selected for strength, pressure rating, and ease of manipulation, though alternative tubing types may be suitably employed in a given application. Preferably, conventional quick-connect or like couplings of a type commercially available are provided.

The joint 26 is preferably mounted generally proximate to the regulator 40. Optionally, the joint 26 may be mounted directly to the regulator 40 thereby eliminating the need for tubing 42, mounted generally proximate to or directly to the fluid container 20 eliminating the need for tubing 32, or mounted in other arrangements as are known to those skilled in the art.

Figure 2:
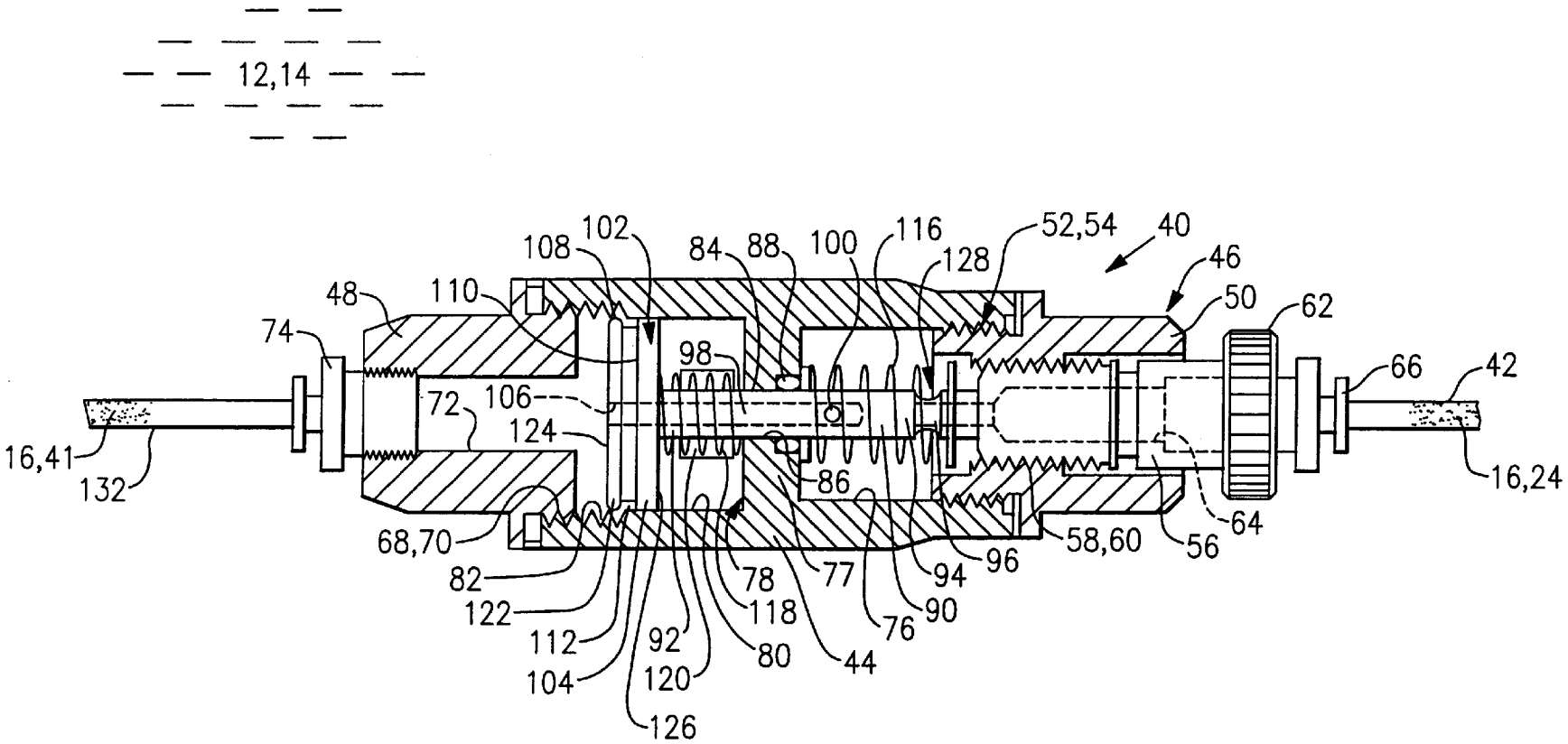
FIG. 2 is a plan view of the pressure regulator of the preferred embodiment.

Referring now to FIG. 2, a pressure regulator 40 is provided for regulating a variable outlet pressure 41 of the fluid 16 at a constant pressure differential relative to the varying ambient fluid pressure 14. Optimally, the pressure regulator 40 provides a generally constant positive pressure differential of about 10 psi over the varying ambient pressure 14 in order to provide a positive pressure for keeping water out of the system, creating air bubbles for a visible indication of a leak in the system 10, and providing for compact and lightweight system components 10. Preferably, the pressure differential is maintained in a range of between about 0 psi and about 50 psi, including during rapid ascents and descents, for the same reasons. Optionally, the pressure regulator 40 may be provided to regulate the variable outlet pressure 41 of the fluid 16 at other pressure differentials as may be desired in a given application. For example, the pressure differential may be maintained in the range of about −5 psi to 5 psi, or −50 psi to 50 psi, in an application where a premium is placed on compact and lightweight system components 10, or the pressure differential may be maintained in the range of about 0 psi to greater than 50 psi where a premium is placed on providing for visible leaks in the system 10 and maintaining the system 10 free of water intrusion. One suitable pressure regulator 40 will now be described, though the pressure system 10 may be suitably employed with alternative pressure regulators capable of accomplishing the desired pressure regulation.

The preferred pressure regulator 40 has a casing 44 with a fluid inlet member 46 and a fluid outlet member 48 coupled thereto. The inlet member 46 has an outer annular member 50 with a threaded outer surface 52 and the casing 44 has a first threaded inner surface 54 that mates therewith to receive and secure the outer annular member 50 to the casing 44. The inlet member 46 also has an inner annular member 56 with a threaded outer surface 58 and the outer annular member 50 has a threaded inner surface 60 that mates therewith to receive and secure the inner annular member 56 to the casing 44 to the outer annular member 50. A grip 62 or the like may be formed on the inner annular member 56 which by rotating permits axial adjustment of the inner annular member 56, wherein the pressure differential described hereinabove may be adjusted as desired. The inner annular member 56 has a bore 64 defined therethrough, and a tubing connector 66 for coupling to tubing 42 to receive therethrough the fluid 16 from the three-way joint 26 into the regulator 40. Preferably, tubing connector 66 is provided by a conventional quick-connect or a like coupling of a type commercially available. The casing 44, outer annular member 50, and inner annular member 56 are preferably made of a metal, a composite or a like material selected for high strength and low weight, and fabricated by techniques known to those skilled in the art.

The fluid outlet member 48 has a threaded outer surface 68 and the casing has a second threaded inner surface portion 70 that mates therewith to receive and secure the outlet member 48 to the casing 44. The fluid outlet member 48 has a bore 72 extending therethrough and a tubing connector 74 for coupling to a main tubing 76 to receive therethrough the fluid 16 from the regulator 40 now at the outlet pressure 41 for distribution to other components of the system 10 as will be described hereinbelow. Preferably, tubing connector 74 is provided by a conventional quick-connect or a like coupling of a type commercially available. The fluid outlet member 48 is preferably made of a metal, a composite or a like material selected for high strength and low weight, and fabricated by techniques known to those skilled in the art.

A first chamber 76 and a second chamber 78 are formed within the casing 44, with a divider wall 79 therebetween and with the second chamber 78 having a first portion 80 and a second portion 82 defined therein. The first chamber 76 is in communication with the inlet member bore 64 and the second chamber second portion 82 is in communication with the outlet member bore 72.

A rod 84 is provided slidingly extending through an opening 86 defined in the wall 77, with a gasket 88 disposed generally within at least a portion of the opening 86 and disposed about the rod 84. The rod 84, opening 86, and gasket 88 are preferably circular in cross-section, though alternative regular or irregular shapes be suitably employed. The fit of the opening 86 and gasket 88 permits the rod 84 to slide axially therethrough, while maintaining a seal therebetween capable of withstanding extreme pressures. The rod 84 is preferably made of a metal, a composite or a like material selected for high strength and low weight, and fabricated by techniques known to those skilled in the art. The gasket 88 may be provided of an elastomer or like resilient material selected for providing a pressure seal.

The rod 84 is generally axially aligned with the inlet bore 64, and has a first end 90 and a second end 92. The first end 90 has a cross-sectional area and is disposed generally within the first chamber 76, and the second end 92 is disposed generally within the second chamber 78.

A seat 94 is attached to the first end 90, and a nipple 96 extends from the inner annular member 56 into the first chamber 76, such that the seat 94 is capable of sealingly covering the inlet bore 64 upon sliding of the rod 64 to prevent fluid 16 from entering the first chamber 76. The seat 94 may be provided of an elastomer or like resilient material selected for providing a pressure seal. Rotating the grip 62 thereby advances or retracts the nipple 96 further into or out of the first chamber 76, changing the position where the seat 94 and nipple 96 engage and thus providing for adjustment of the outlet pressure 41.

The rod 84 has a bore 98 defined axially through a portion thereof and extending through the rod second end 92, and has an aperture 100 defined radially therein generally proximate the rod first end 90. The rod aperture 100 is in communication with the rod bore 98 to allow fluid 16 to flow therethrough from the first chamber 76.

A piston head 102 is slidingly movable within the second chamber 78. The head 102 has a first end 104 attached to the rod second end 92 and has a bore 106 coextensively defined therein such that head bore 106 and the rod bore 102 are generally axially aligned. The fluid 16 may thereby be conveyed from the first chamber 76 through the rod aperture 100, the rod bore 98, and the head bore 106, and into the second chamber 82.

The piston head 102 and second chamber are preferably cylindrical, though other regular and irregular shaped chambers may be employed. The head 102 has an outer sidewall 108 with a recess 110 defined therein and a ring gasket 112 seated in the recess, the gasket providing sliding engagement with sidewalls of the second chamber. The piston head 102 is preferably made of a metal, a composite or a like material selected for high strength and low weight, and fabricated by techniques known to those skilled in the art. The gasket 112 may be provided of an elastomer or like resilient material selected for providing a pressure seal.

A first spring 116 may be provided disposed about the rod 84 in the first chamber such that the first spring 116 biases the inlet member 46 away from the divider wall 77 to maintain a pressure on the threaded surfaces 52, 54, 58, 60, acting as a sort of lock washer to secure the surfaces 52, 54, 58, 60, in place. A second spring 118 may be provided disposed about the rod 84 in the second chamber first portion 80 such that the second spring 118 biases the piston head 102 away from the divider wall 77. The second spring 118 thereby assists in the adjustment of the desired pressure differential because when the grip 62 is rotated to retract the nipple 96 away from the seat 94, then the second spring 118 creates a greater force that must be overcome by pressure on the head 102 for the seat 94 to slide toward, engage and seal the nipple 96. The springs 116, 118 are preferably metal or the like coil springs or the like, though alternative springs may be suitably employed.

The casing 44 has at least one ambient access opening 120, and preferably two openings 120, defined in the second chamber first portion 80 to allow the ambient fluid 12 to enter the second chamber first portion 80. The piston head 102 is prevented from covering and blocking the openings 120 by the second spring 118.

The piston head 102 has a second end 122 with a surface area 124 defined thereon, and the head first end 104 has a surface area 126 defined thereon that is about equal to the second end surface area 124 less a cross-sectional area 128 of the rod 84. The piston head first end surface area 126, the piston head second end surface area 124, and the rod cross-sectional area 128 are selected so that the area ratio of the head second area 116 to the rod cross-sectional area 128 is substantially the same as the desired generally constant pressure ratio of the inlet pressure 24 to the positive pressure differential of the variable outlet pressure 41 over the variable ambient pressure 14. With such a ratio, when the inlet pressure 24 acting on the rod cross-sectional area 128 plus the variable ambient pressure 14 acting on the head first area 126 is greater than the variable outlet pressure 41 acting on the head second area 124, such as when beginning to descend in water, then the piston 102, rod 84, and rod seat 94 are forced away from the nipple 96 of the inlet 46 to allow fluid into the first chamber 76. The fluid 16 is then conveyed through the rod bore 98 into the second chamber second portion 82 and out the outlet member 48 to pressurize the system 10. When the system 10 exceeds the desired pressure differential over ambient pressure, that is, when the inlet pressure 24 acting on the rod cross-sectional area 128 plus the variable ambient pressure 14 acting on the head first area 126 is less than the variable outlet pressure 41 acting on the head second area 124, then the piston 102, rod 84, and rod seat 94 are then forced into abutment with the nipple 96 to seal out the inlet fluid 16. Upon further increase of the ambient pressure 14, such as from descending further underwater, the piston 102, rod 84, and rod seat 94 are again moved away from the nipple 96 to increase the outlet pressure 41 to maintain the positive pressure differential over the ambient pressure 14.

It should be noted that the regulator 40 may optionally be provided with a greater or lesser ratio of the head second area 116 to the rod cross-sectional area 128 so that other outlet pressure differentials may be accomplished and/or other inlet pressures may be utilized. For example, the regulator 40 may be provided with the ratio of the head second area 116 to the rod cross-sectional area 128 such that the tank pressure 18 may be regulated to the desired outlet pressure 41 with a single pressure regulator (not shown) employed to regulate the system pressure, thereby to eliminating the need for the tank regulator 22.

Referring now back to FIG. 1, there is preferably provided at least one main housing 130 coupled to the regulator outlet 48 with at least one main tubing 132 for receiving the fluid 16 therethrough at the outlet pressure 41. The main housing 130 may have a removable lid for access to items therein, such as underwater equipment, instrumentation, sundry items, and the like.

At least one pressure relief valve 134 is provided preferably arranged on the main housing 130 for releasing fluid 16 from the system 10 to decrease the inlet pressure 41 of the system 10 upon a decrease in the variable ambient pressure 14, such as upon ascending in water. The relief valve 134 is of a type conventionally used and commercially available, and may be selected based upon the desired maximum pressure differential of the inlet pressure 41 relative to the ambient pressure 14 so that the valve 134 releases fluid 16 from the housing 130 upon ascension as the ambient pressure 14 decreases and the pressure differential therefore increases. Optionally, the relief valve may be arranged on other housings which are described hereinbelow.

At least one pressure gauge 136 of a conventional type is preferably provided, coupled to the main housing 130 by tubing 138 for receiving fluid 16 therethrough at inlet pressure 41. Preferably, conventional quick-connect or like couplings of a type commercially available are provided. The pressure gauge 136, the regulator, and the three-way joint may be mounted together on a bracket 140 for convenience.

At least one electric control system 142 is preferably contained within the main housing 130. The electric control system 142 is provided with conventional electric components known to those skilled in the art for operation and control of electric devices.

A plurality of first peripheral housings 144 are preferably provided as desired in a given application, each first peripheral housing having a first tube 146 coupled to the main housing 130 for receiving the fluid 16 therethrough at the outlet pressure 41. The tubes 146 are preferably arranged in a parallel configuration, so that failure of one first peripheral tube 146 or one first peripheral housing 144 will not directly cut off the supply of fluid 16 under pressure 41 to the other first peripheral housings 144 and tubes 146. Optionally, tubes 146 may be arranged in a series configuration as it may in certain applications be desirable to interconnect all the housings 144 by tubing 146 and/or to feed fluid 16 to the housings 144 by two or more tubes 146. The peripheral housings 144 may have removable lids with gaskets or like seals for access to the control system 142 and any other items contained therein, such as underwater equipment, instrumentation, cameras and other audio and/or video equipment, surveying equipment, metal detectors, SONAR, sundry items, and the like.

A plurality of first peripheral electric devices 148 are preferably provided as desired in a given application and are contained within the first peripheral housings 144, and a plurality of first peripheral electric wires 150 are preferably interconnected between the electric control system 142 and each of the first electric devices 148, with the first peripheral wires 150 extending through the first peripheral tubing 146, as shown in FIGS. 3 and 4. Preferably, the first peripheral electric devices 148 include at least one power supply 148*a* such as a conventional battery, in at least one power supply housing 144*a* connected to the control system 142 by wiring 150*a* through tubing 146*a*, at least one power supply meter 148*b* of the conventional type in at least one power supply meter housing 144*b* connected to the control system 142 by wiring 150*b* through tubing 146*b*, and at least one motor control system 148*c* of the conventional type in at least one motor control system housing 144*c* connected to the control system 142 by wiring 150*c*. Optionally, other underwater equipment, instrumentation, and the like as described hereinabove may be enclosed in additional or the same housings 144.

A plurality of second peripheral housings 152 may be provided as desired in a given application, each second peripheral housing 152 having a second peripheral tube 154 preferably coupled to one of the first peripheral housings 144 such as the motor control system housing 144*c*, for receiving fluid 16 therethrough at the outlet pressure 41. The tubes 154 are preferably arranged in a parallel configuration, so that failure of one first peripheral tube 154 or one first peripheral housing 152 will not directly cut off the supply of fluid 16 under pressure 41 to the other first peripheral housings 152 and tubes 154. The peripheral housings 152 may have removable lids for access to items therein, such as underwater equipment, instrumentation, sundry items, and the like.

A plurality of second peripheral electric devices 156 are preferably contained within the second peripheral housings 152, and a plurality of second peripheral electric wires 158 are preferably interconnected between the motor control system 148c and each of the second electric devices 156, with the second peripheral wires 158 extending through the second peripheral tubing 154, as shown in FIGS. 3 and 4. Preferably, the second peripheral electric devices 156 include at least one motor switch 156*a* of the conventional type in at least one motor switch housing 152*a* connected to the motor control system 148*c* by wiring 158*a* through tubing 154*a*, and at least one motor and propeller 156*b* of the conventional type in at least one motor and propeller unit housing 152*b* connected to the motor control system 148*c* by wiring 158*b* through tubing 154*b*. The second peripheral housings 152*a–b* may thereby be arranged most efficiently and ergonomically by positioning the second electric devices 156*a–b* where desired without regard to proximity to the main control panel for inlet pressure 41.

Preferably, the tubing 132, 146*a–c*, and 154*a–b* is provided by conventional pneumatic tubing and selected for strength, pressure rating, and ease of manipulation, though alternative tubing types may be suitably employed in a given application. Preferably, the housings 130, 144*a–c*, and 152*a–b* are provided with conventional quick-connect or like couplings of a type commercially available for coupling to the tubing 132, 146*a–c*, and 154*a–b*.

The housings 130, 144*a–c*, and 152*a–b* are preferably made of a metal, a composite, a thermoplastic resin, a carbon fiber, or a like material selected for high strength and low weight, and fabricated by techniques known to those skilled in the art. Because the housings 130, 144*a–c*, and 152*a–b* are maintained at a pressure with a nominal pressure differential relative to the variable ambient pressure 14, the housings 130, 144*a–c*, and 152*a–b* may be constructed of lighter weight materials and with thinner walls than are required to withstand the extreme pressures experienced at depths. Because the housings 130, 144*a–c*, and 152*a–b* are maintained at a positive pressure over the ambient pressure 14, a housing 130, 144*a–c*, and 152*a–b* with a small otherwise undetectable leak will leak air bubbles out instead of water into the housing 130, 144*a–c*, and 152*a–b*, providing a visible indication of a leak prior to a catastrophic failure of one of the tubes 132, 146*a–c*, and 154*a–b* or housings 130, 144*a–c*, and 152*a–b*. The system 10 may be adapted for use at any ambient pressure 14, with the pressure 18 of the compressed fluid 16 selected to be generally greater than the ambient pressure 14, the pressure regulator 40 selected based on the compressed fluid pressure 18 and the ambient fluid pressure 14, and the pressure ratings of the housings, tubing, and connectors selected to withstand with the ambient pressure 14.

Figure 5:
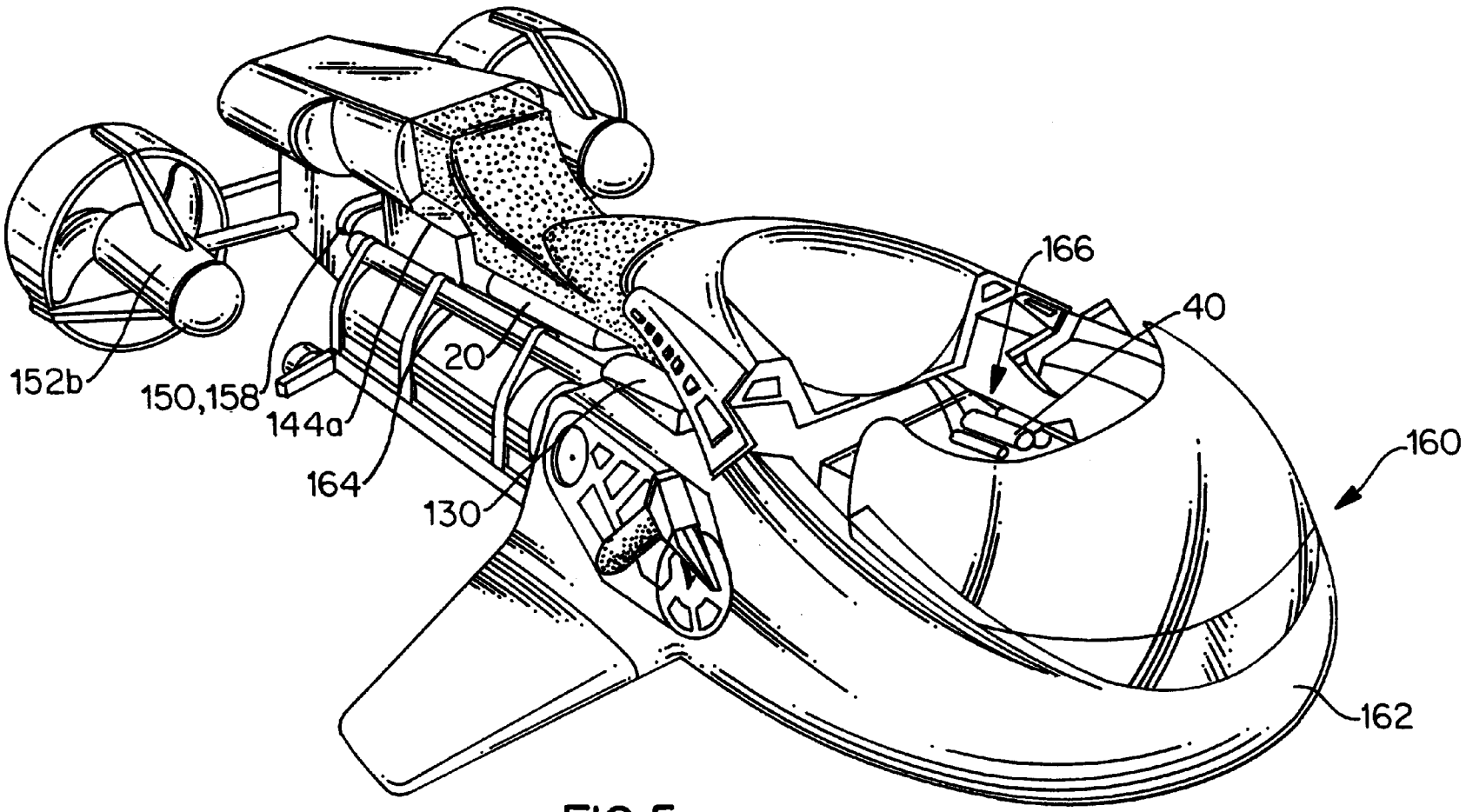
FIG. 5 is a perspective view of the preferred embodiment incorporated in a diver propulsion vehicle.

The regulated pressurized system 10 is preferably used in conjunction with an underwater apparatus such as a device that may be lowered into the water, a DPV, an underwater scooter, or the like. Optionally, the system 10 may be suitably employed with any apparatus having components that must be kept free of an ambient fluid and that are subject to a varying ambient fluid pressure. As shown in FIG. 5, when the system 10 is used with a DPV 160, the fluid container 20, pressure regulator 40, and housings 130, 144*a–c*, and 152*a–b* may be mounted to a body 162 of the DPV 160. Conventional conduit 164 may be provided for routing the tubing 150, 158 therethrough for added protection thereof. The pressure regulator 40, three-way joint 26, and pressure gauge 136 are preferably mounted in a generally forward area 166 of the DPV 160 to provide ease of access thereto for adjusting the inlet pressure 41 by rotating the grip 62 and for visual inspection of the pressure gauge 136. The power supply housing 144*a* and motor control system housing 144*c* are preferably mounted on the DPV 160 at positions selected for providing balance, stability, and proximity to the motor and propeller units 152*b*.

In operation, before launching the DPV 160 or the like with the regulated pressurized system 10 mounted thereto into the water or like fluid 12, the fully charged container 18 of compressed air or a like fluid 16 is connected to the regulator 40 by the tubing 32 and the regulator 22 on the container 20 is opened to release the compressed fluid 16. The housings 130, 144*a–c*, and 52*a–b* are initially at the same pressure 41 as the ambient fluid 12 of air, so the pressure regulator 40 will pressurize the housings to a nominal positive pressure differential of preferably about 10 psi above the ambient pressure 14.

When the DPV 160 is launched and commences to dive, the ambient water pressure 14 increases in accordance with the increasing depth of the DPV 160, forcing the piston head 102, rod 84, and seat 94 to slide away from the nipple 96 of the pressure regulator 40 to allow the compressed air 16, 24 to further increase the pressure 41 in the housings 130, 144*a–c*, and 52*a–b* to maintain the desired positive pressure differential. If the DPV 160 travels laterally at a generally constant depth of water 12, the ambient pressure 14 will then stabilize and the piston head 102, rod 84, and seat 94 will be forced to slide toward the nipple 96, the seat 94 and the nipple 96 thereby sealing the first chamber 76 from the compressed air 16, 24 to maintain the pressure 41 in the housings 130, 144*a–c*, and 52*a–b*. Subsequent descending causes the regulator 40 to further pressurize the housings 130, 144*a–c*, and 52*a–b* as described hereinabove. As the system 10 is pressurized by discharging the fluid 16 from the container 20, the pressure 18 in the container 20 decreases accordingly.

Upon ascension of the DPV 160, the ambient pressure 14 decreases as the DPV rises in the water 12, and the pressure differential of the inlet pressure 41 over the ambient pressure 14 therefore increases. When the pressure differential exceeds the desired pre-selected level, the pressure relief valve 134 releases the excess pressure from the housings 130. Upon completion of the dive, the DPV may be re-equipped with a recharged fluid container 20 for subsequent dives.

Accordingly, there are a number of advantages provided by the present invention. There is provided a system 10 of at least one and preferably a plurality of submersible housings 130, 144, and 152 capable of withstanding extreme and varying ambient pressures 14 without leaking, providing the advantage of sealing and protecting electrical systems, underwater equipment, instrumentation and/or the like when diving, exploring, and ascending in moderate to extreme depths of an underwater environment 12.

Also, there is provided a compressed air supply 16, 18, a pressure regulator 40 connected to the housings 130, 144, and 152 by pneumatic tubing 132, 146, and 154, and a relief valve 134 in at least one housing 130, 144, and 152 so as to maintain a pressure 41 within the housings 130, 144, and 152 at a nominal differential from the ambient pressure 14 at a given depth of water 12, providing the advantage of the submersible housings 130, 144, and 152 made with minimal structural requirements to permit compactness and low weight yet also with a superior protective seal against water leakage.

Additionally, there is provided pressurized pneumatic tubing 132, 146, and 154 interconnecting the housings 130, 144, and 152 with electrical wiring 150 and 158 routed therethrough, providing the advantage of sealing and protecting any electrical system control and/or power wiring 150 and 158 from access by the ambient water 12 and from degradation and/or failure thereof.

Furthermore, there is provided a pressure regulator 40 having a piston cylinder valve arrangement 84 and 102 and two chambers 76 and 78 to produce a pressure drop across the regulator 40 relative to a variable reference pressure 14, providing the advantage of a maintaining the housings 130, 144, and 152 free of intrusion by the ambient fluid 12 and providing a visual indication of a leak in any of the housings 130, 144, and 152 by achieving and maintaining a positive pressure 41 within the housings 130, 144, and 152 and tubing 132, 146, and 154 so that air bubbles are released from any housing leak, with the positive pressure within the housings 130, 144, and 152 and tubing 132, 146, and 154 preferably at about 10 psi relative to the ambient pressure 14 at any given depth under typical usage conditions, and even during a rapid ascent and/or descent in the range of about 0 to 50 psi relative to the varying ambient pressure 14.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A regulated pressurized system for use in an ambient fluid environment, comprising:

a) at least one pressure regulator having a fluid inlet capable of communication with a fluid supply and a fluid outlet, and capable of being regulated relative to an ambient pressure of said ambient fluid;

b) at least one housing having at least one pressure relief valve and at least one fluid inlet in communication with said pressure regulator fluid outlet, said housing capable of being regulated by said pressure regulator at a pressure relative to an ambient pressure of said ambient fluid; and, c) a three way joint with an inlet in communication with said fluid supply, a first outlet, and a second outlet in communication with said pressure regulator fluid inlet, wherein said first outlet is available for pressurizing an external device.

2. The regulated pressurized system of claim 1, wherein said three-way joint is mounted generally proximate to said pressure regulator.

3. The regulated pressurized system of claim 1, wherein said three-way joint is mounted generally proximate to said fluid supply.

4. A regulated pressurized system for use in an ambient fluid environment, comprising:

a) at least one pressure regulator having a fluid inlet capable of communication with a fluid supply and a fluid outlet, and capable of being regulated relative to an ambient pressure of said ambient fluid;

b) at least one main housing having at least one pressure relief valve and at least one fluid inlet in communication with said pressure regulator fluid outlet, said housing capable of being regulated by said pressure regulator at a pressure relative to an ambient pressure of said ambient fluid; and, c) at least one first peripheral housing, at least one main tube coupled between said main housing and said pressure regulator outlet, and at least one first peripheral tube coupled between said main housing and each said first peripheral housing, said first peripheral housings capable of being regulated by said pressure regulator at a pressure relative to an ambient pressure of said ambient fluid.

5. The regulated pressurized system of claim 4, wherein each first peripheral housing tubing is coupled to said main housing in a parallel configuration.

6. The regulated pressurized system of claim 4, wherein said relief valve is arranged on said main housing.

7. The regulated pressurized system of claim 4, further comprising at least one pressure gauge and at least one tube coupled between said main housing and said pressure gauge.

8. The regulated pressurized system of claim 4, further comprising at least one main electric device contained in said main housing, at least one first electric device contained in at least one of said first peripheral housings, and at least one first peripheral electric wire interconnecting said main electric device and said first peripheral electric device, said first peripheral wire extending through said first peripheral tubing.

9. The regulated pressurized system of claim 8, wherein said main electric device comprises a main electric control system and said first peripheral electric devices comprise at least one power supply and at least one motor control system interconnected to said main electric control system by first peripheral wiring extending through said first peripheral tubing.

10. The regulated pressurized system of claim 4, further comprising at least one second peripheral housing and at least one second peripheral tube coupled between at least one said first peripheral housing and each said second peripheral housing, said second peripheral housings capable of being regulated by said pressure regulator at a pressure relative to an ambient pressure of said ambient fluid.

11. The regulated pressurized system of claim 8, further comprising at least one second peripheral housing and at least one second peripheral tube coupled between at least one said first peripheral housings and each said second peripheral housing, said second peripheral housings capable of being regulated by said pressure regulator at a pressure relative to an ambient pressure of said ambient fluid.

12. The regulated pressurized system of claim 11, further comprising at least one second peripheral electric device contained in at least one second peripheral housing and at least one second peripheral electric wire interconnecting said each said second electric device and one of said first peripheral electric devices, said second peripheral wire extending through said second peripheral tubing.

13. The regulated pressurized system of claim 12, wherein said second peripheral electric devices comprise at least one motor switch and at least one motor and propeller unit interconnected by second peripheral wiring to a motor control system, said second peripheral wiring extending through said second peripheral tubing.

14. A regulated pressurized system for use in an ambient fluid environment, comprising:

a) at least one compressed air supply;

b) at least one pressure regulator having an air inlet in communication with said compressed air supply and an air outlet capable of being regulated relative to an ambient pressure of said ambient fluid;

c) a three way joint with an inlet in communication with said air supply, a first outlet, and a second outlet in communication with said pressure regulator air inlet, wherein said first outlet is available for pressurizing an external device;

d) at least one main housing having at least one pressure relief valve and in communication with said pressure regulator air outlet;

e) at least one electric control system contained within said main housing;

f) a plurality of first peripheral housings, each first peripheral housing having a first tube coupled to said main housing in a parallel configuration;

g) a plurality of first peripheral electric devices contained within said first peripheral housings, wherein said first peripheral electric devices comprise at least one pressure gauge, at least one power supply, at least one power supply meter, and at least one motor control system;

h) a plurality of first peripheral electric wires interconnected between said electric control system and each of said first electric devices, said wires extending through said first tubing;

i) a plurality of second peripheral housings, each second peripheral housing having a second tube coupled to said motor control system peripheral housing in a parallel configuration;

j) a plurality of second peripheral electric devices contained within said second peripheral housings, wherein said second peripheral electric device comprises at least one motor switch and at least one motor and propeller; and, k) a plurality of second peripheral electric wires interconnected between said motor control system and each of said second peripheral electric devices, said second wires extending through said second tubing.

15. The regulated pressurized system of claim 14, wherein said compressed air supply comprises a submersible tank.

16. The regulated pressurized system of claim 14, wherein said three way joint is mounted generally proximate to said pressure regulator, and further comprising at least one tube coupled between said fluid supply and said joint inlet an at least one tube coupled between one of said joint outlets and said regulator inlet.

17. The regulated pressurized system of claim 14, said pressure regulator further comprising:

a) a casing having a first chamber and a second chamber with a first portion and a second portion defined within said second chamber, said fluid inlet in communication with said first chamber and said fluid outlet in communication with said second chamber second portion;

b) a rod slidingly extending through a wall dividing said first and second chambers, said rod having a first end disposed within said first chamber, said rod first end having a cross-sectional area and a seat attached thereto, said rod having a second end disposed within said second chamber, said rod having a bore defined axially therethrough and in communication with said first chamber;

c) a piston head slidingly movable within said second and chamber and having a bore defined therethrough, said head having a first end attached to said rod and a surface area defined thereon, said head having a second end with a surface area defined thereon, said second end surface area and said rod cross-sectional area defining a ratio that is substantially equal to a ratio defined by an inlet pressure in said first chamber and a generally constant positive pressure differential of a variable outlet pressure in said second chamber second portion relative to said variable ambient pressure; and, d) at least one ambient access opening defined in said second chamber second portion.

18. The regulated pressurized system of claim 14, wherein said rod cross-sectional area, said head first end surface area, and said head second end surface area are defined such that said inlet pressure acting on said rod cross-sectional area plus said variable ambient pressure acting on said head first end surface area are about equal to or greater than said variable outlet pressure acting on said head second end surface area.

19. The regulated pressurized system of claim 14, further comprising an underwater vehicle with said fluid supply, said pressure regulator, and said housing mounted thereto.

20. A pressure regulator for a pressurized system, comprising:

a) a casing having a first chamber and a second chamber with a first portion and a second portion defined in said second chamber, said casing having a fluid inlet member with a bore extending therethrough and a fluid outlet member with a bore extending therethrough, said inlet member having a tubing connector for coupling to a compressed fluid supply, said inlet member further comprising an outer annular member with a threaded inner surface and an inner annular member with a threaded outer surface that mates therewith, said inner member having a grip permitting axial adjustment of said inlet member relative to said rod first end, wherein said pressure differential may be adjusted as desired, said outlet member having a tubing connector for coupling to a pressurized system;

b) a rod slidingly extending through a wall dividing said first and second chambers, said rod generally axially aligned with said inlet bore and having a first end with a cross-sectional area disposed within said first chamber, said rod first end having a seat attached thereto that is capable of sealingly covering said inlet bore upon sliding of said rod, said rod having a second end disposed within said second chamber, said rod having a portion with a bore defined axially therethrough and extending through said rod second end, said rod having an aperture defined in a sidewall thereof generally proximate said rod first end, said rod aperture in communication with said rod bore;

c) a piston head slidingly movable within said second chamber and having a bore coextensively defined therethrough, said head having a first end attached to said rod second end wherein said head bore and said rod bore are generally axially aligned, said first end having a surface area defined thereon, said head having a second end with a surface area defined thereon, said second end surface area and said rod cross-sectional area defining a ratio that is about equal to a ratio defined by an inlet pressure in said first chamber and a generally constant positive pressure differential of a variable outlet pressure in said second chamber second portion to said variable ambient pressure; and, d) at least one ambient access opening defined in said second chamber first portion.

21. A pressure regulator for a pressurized system, comprising:

a) a casing having a first chamber and a second chamber with a first portion and a second portion defined in said second chamber, said casing having a fluid inlet member with a bore extending therethrough and a fluid outlet member with a bore extending therethrough, said inlet member having a tubing connector for coupling to a compressed fluid supply, said outlet member having a tubing connector for coupling to a pressurized system;

b) a rod slidingly extending through a wall dividing said first and second chambers, said rod generally axially aligned with said inlet bore and having a first end with a cross-sectional area disposed within said first chamber, said rod first end having a seat attached thereto that is capable of sealingly covering said inlet bore upon sliding of said rod, said rod having a second end disposed within said second chamber, said rod having a portion with a bore defined axially therethrough and extending through said rod second end, said rod having an aperture defined in a sidewall thereof generally proximate said rod first end, said rod aperture in communication with said rod bore;

c) a piston head slidingly movable within said second chamber and having a bore coextensively defined therethrough, said head having a first end attached to said rod second end wherein said head bore and said rod bore are generally axially aligned, said first end having a surface area defined thereon, said head having a second end with a surface area defined thereon, said second end surface area and said rod cross-sectional area defining a ratio that is about equal to a ratio defined by an inlet pressure in said first chamber and a generally constant positive pressure differential of a variable outlet pressure in said second chamber second portion to said variable ambient pressure;

d) at least one ambient access opening defined in said second chamber first portion; and, e) a nipple extending from said inlet member into said first chamber.

22. A pressure regulator for a pressurized system, comprising:

a) a casing having a first chamber and a second chamber with a first portion and a second portion defined in said second chamber, said casing having a fluid inlet member with a bore extending therethrough and a fluid outlet member with a bore extending therethrough, said inlet member having a tubing connector for coupling to a compressed fluid supply, said outlet member having a tubing connector for coupling to a pressurized system;

b) a rod slidingly extending through a wall dividing said first and second chambers, said rod generally axially aligned with said inlet bore and having a first end with a cross-sectional area disposed within said first chamber, said rod first end having a seat attached thereto that is capable of sealingly covering said inlet bore upon sliding of said rod, said rod having a second end disposed within said second chamber, said rod having a portion with a bore defined axially therethrough and extending through said rod second end, said rod having an aperture defined in a sidewall thereof generally proximate said rod first end, said rod aperture in communication with said rod bore;

c) a piston head slidingly movable within said second chamber and having a bore coextensively defined therethrough, said head having a first end attached to said rod second end wherein said head bore and said rod bore are generally axially aligned, said first end having a surface area defined thereon, said head having a second end with a surface area defined thereon, said second end surface area and said rod cross-sectional area defining a ratio that is about equal to a ratio defined by an inlet pressure in said first chamber and a generally constant positive pressure differential of a variable outlet pressure in said second chamber second portion to said variable ambient pressure; and, d) at least one ambient access opening defined in said second chamber first portion, wherein said wall dividing said first and second chambers has an opening defined therethrough, and further comprising a gasket disposed generally within said opening that slidingly receives said rod therethrough.

23. A pressure regulator for a pressurized system, comprising:

a) a casing having a first chamber and a second chamber with a first portion and a second portion defined in said second chamber, said casing having a fluid inlet member with a bore extending therethrough and a fluid outlet member with a bore extending therethrough, said inlet member having a tubing connector for coupling to a compressed fluid supply, said outlet member having a tubing connector for coupling to a pressurized system;

b) a rod slidingly extending through a wall dividing said first and second chambers, said rod generally axially aligned with said inlet bore and having a first end with a cross-sectional area disposed within said first chamber, said rod first end having a seat attached thereto that is capable of sealingly covering said inlet bore upon sliding of said rod, said rod having a second end disposed within said second chamber, said rod having a portion with a bore defined axially therethrough and extending through said rod second end, said rod having an aperture defined in a sidewall thereof generally proximate said rod first end, said rod aperture in communication with said rod bore;

c) a piston head slidingly movable within said second chamber and having a bore coextensively defined therethrough, said head having a first end attached to said rod second end wherein said head bore and said rod bore are generally axially aligned, said first end having a surface area defined thereon, said head having a second end with a surface area defined thereon, said second end surface area and said rod cross-sectional area defining a ratio that is about equal to a ratio defined by an inlet pressure in said first chamber and a generally constant positive pressure differential of a variable outlet pressure in said second chamber second portion to said variable ambient pressure;

d) at least one ambient access opening defined in said second chamber first portion; and, e) a first spring disposed about said rod in said first chamber, wherein said first spring biases said inlet member away from said dividing wall.

24. A method of regulating pressure in a system of housings in an ambient fluid environment, comprising:

a) conveying a compressed fluid from a fluid supply at a constant inlet pressure into a pressure regulator;

b) decreasing said constant inlet pressure to a variable outlet pressure;

c) regulating said variable outlet pressure at a positive pressure differential relative to an ambient pressure wherein said variable outlet pressure is increased upon an increase of said ambient pressure;

d) conveying said fluid at said variable outlet pressure from said pressure regulator into at least one main housing such that said main housing is maintained at said positive pressure differential relative to said ambient pressure;

e) conveying said fluid at said variable outlet pressure from said main housing through tubing into at least one peripheral housing such that said peripheral housing is maintained at said positive pressure differential relative to said ambient pressure; and, f) releasing said variable outlet pressure from said main housing upon a decrease in said ambient pressure such as when ascending in a fluid.

25. The method of regulating pressure of claim 24, further comprising the step of splitting said compressed fluid supply so that a portion of said fluid is conveyed into said regulator and another portion of said fluid is conveyed into an external device for pressurizing thereof.

26. The method of regulating pressure of claim 24, further comprising the steps of storing an electric control system in said main housing, storing peripheral electric devices in said peripheral housings, and routing electric wires through said tubing for connection between said electric control system and said peripheral electric devices.

27. The method of regulating pressure of claim 24, wherein said step of regulating said variable outlet pressure comprises the steps of applying said inlet pressure to a rod cross-sectional area in a first chamber and applying said variable ambient pressure to a piston head first end surface area in a first portion of a second chamber to overcome applying said variable outlet pressure to a piston head second end surface area in a second portion of a second chamber, wherein said compressed fluid is capable of communication between said first chamber and said second chamber second portion.

* * * * *